US005513848A

United States Patent [19]

Keener

[11] Patent Number: 5,513,848

[45] Date of Patent: May 7, 1996

[54] FISHING BOARD GAME

[75] Inventor: Daniel N. Keener, Fulton, N.Y.

[73] Assignee: Daniel Norman Keener, Key West, Fla.

[21] Appl. No.: 398,674

[22] Filed: Mar. 6, 1995

[51] Int. Cl.[6] ..... A63F 3/00

[52] U.S. Cl. ..... 273/244

[58] Field of Search ..... 273/242, 243, 273/244, 277

[56] References Cited

U.S. PATENT DOCUMENTS

| | | | |
|---|---|---|---|
| 3,168,314 | 2/1965 | Washburn | 273/243 |
| 3,888,489 | 6/1975 | Kane | 273/244 |
| 3,921,981 | 11/1975 | Ashburn | 273/244 |
| 4,003,578 | 1/1977 | Jones | 273/244 |
| 4,290,608 | 9/1981 | Brown | 273/244 X |
| 4,368,889 | 1/1983 | Reker | 273/243 |
| 5,176,385 | 1/1993 | Tagliaferro | 273/244 |
| 5,186,466 | 2/1993 | Mudd et al. | 273/244 |
| 5,248,147 | 9/1993 | Smith | 273/244 |

FOREIGN PATENT DOCUMENTS

| | | | |
|---|---|---|---|
| 1405897 | 9/1975 | United Kingdom | 273/244 |
| 2123304 | 2/1984 | United Kingdom | 273/244 |

*Primary Examiner*—William E. Stoll

[57] ABSTRACT

The invention relates to a simulated fishing tournament that is played out on a game board bearing a representation of a body of water. The players, as represented by their respective game pieces, follow a path formed by a continuous series of identified board spaces and attempt to collect simulated fishing baits that are later used to catch a variety of fish species as represented by Bite cards. The player, weighs his or her catch by rolling a die or dice and records the numerical value of the dice roll on the Bite card in poundage. The players encounter a variety of situations created by game play that involve environmental, conservation and sportsmanship issues. The game is intended to provide an atmosphere that is exciting and enjoyable for the participants and serve as an educational tool for those unfamiliar with the activity of fishing or fish species.

2 Claims, 2 Drawing Sheets

FISHING BOARD GAME

BRIEF SUMMARY OF THE INVENTION

The invention relates to board game equipment for a simulated fishing tournament whereby the players, represented by a plurality of playing pieces, participate in the simulated activity of a fishing tournament. The play of the invention takes place on a game board on which is a graphic illustration representing a body of water that utilizes the perimeter of the body of water as a continuous series of board spaces bearing indicia identifying action to be taken by the players when landing on particular board spaces. The players move their respective game pieces according to the numerical value of a dice roll following the path formed by the continuous series of board spaces. The object of the game relating to the players, is to acquire Bait cards which represent a variety of simulated fishing Baits by landing the players game piece on the board spaces identified with the word Bait, and later utilizing the Bait cards to catch corresponding Bite cards which represent a plurality of fish species, by landing the players game piece on the board spaces identified with the word Bite. The player then weights the catch represented by the Bite card by rolling the die or dice as directed by the indicia on the bite card and records the weight represented in poundage on the bite card with a grease pencil or other suitable writing instrument. The Bite cards are retained by the players and tallied at game's end to determine the winner. The players also encounter a variety of other simulated situations as directed by indicia on the game board spaces and the Bait and Bite cards such as lose one fish, lose one turn, add weight to catch etc. Game play concludes when a predetermined time limit established by the players expires. The game winner is the player who acquired the most total weight of catch in poundage as represented by the Bite cards at games end. The game attempts to promote good sportsmanship, environmental conservation and environmental awareness by way of indicia on the game board spaces, Bait and Bite playing cards and situations created by game play. The game also attempts to provide educational aspects by accurately identifying various fish species by way of the representations made on the Bite cards and by providing each species Latin or scientific species nomenclature. The game attempts to create an atmosphere that is exciting and enjoyable for the players who are familiar with the activity of fishing and for those whom are not. The game in its present form is intended to be played by 2 to 8 players.

BRIEF DESCRIPTION OF THE DRAWINGS AND EXHIBITS

FIG. S shows a representation of a sample of a bite card identifying a fish species.

Figure 6:
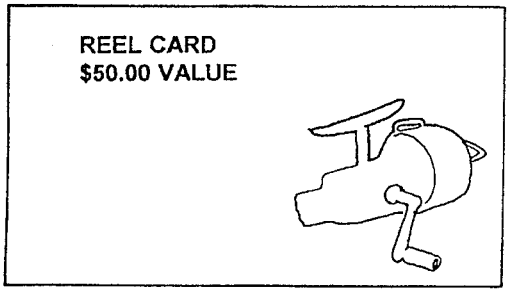

FIG. 6 shows a representation of a simulated fishing reel card.

Figure 7:
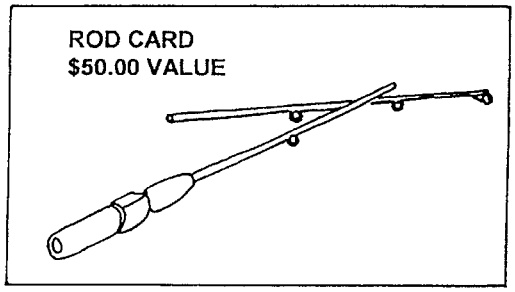

FIG. 7 shows a representation of a simulated fishing rod card.

Figure 8:
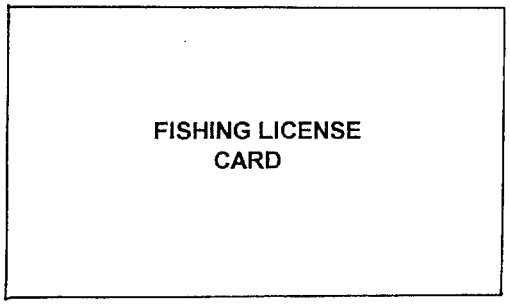

FIG. 8 shows a representation of a simulated fishing license card.

Figure 9:
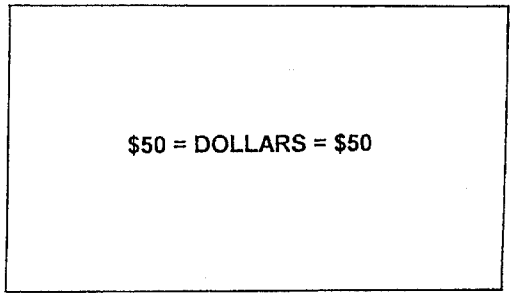

FIG. 9 shows a representation of a simulated money card.

Exhibit A—is the manual of rules and directions of play as will be presented to the game participants. This manual is incorporated herein by reference.

DESCRIPTION OF THE PREFERRED EMBODIMENT

Figure 1:
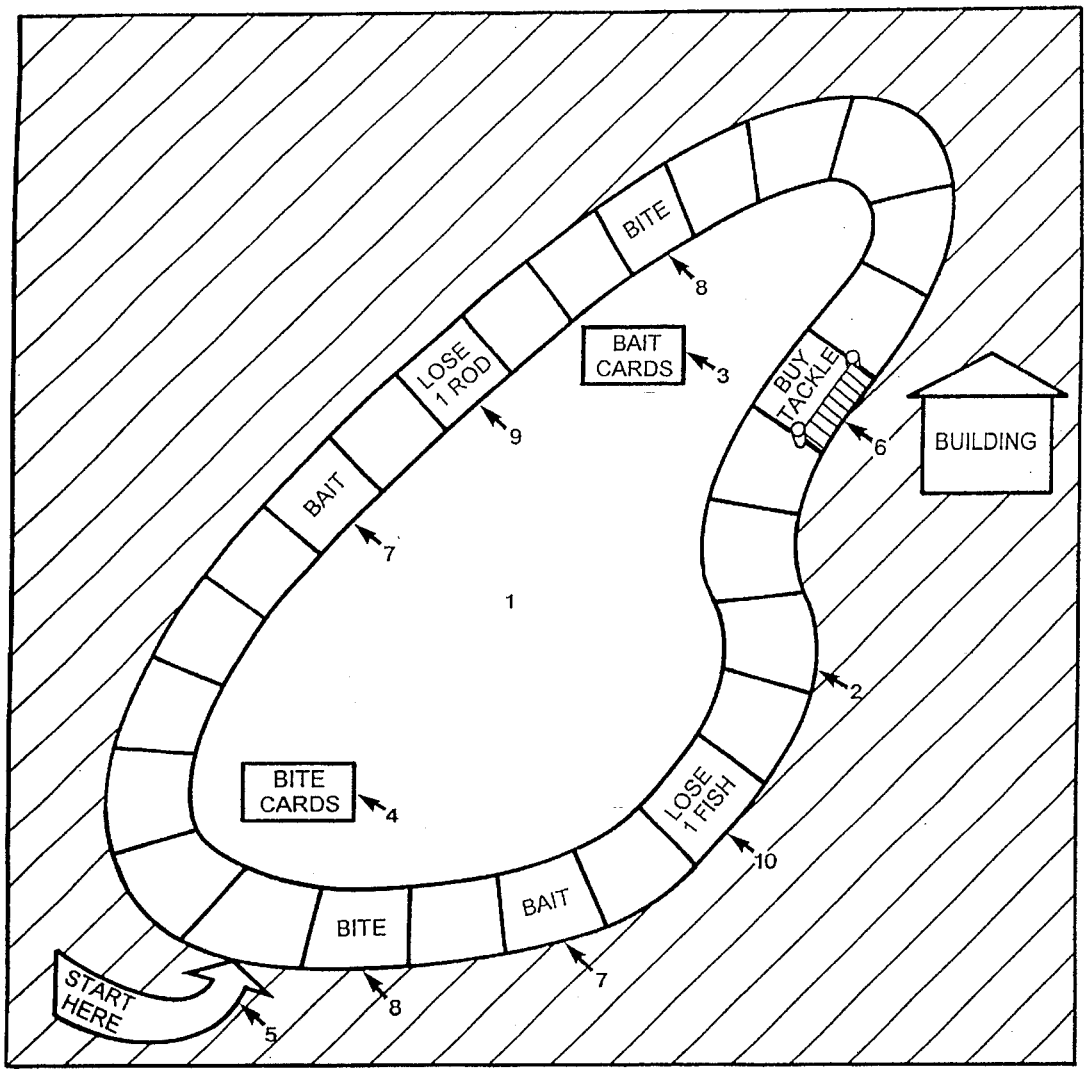
FIG. 1 shows the game board containing a representation of a body of water with a continuous series of identified spaces forming the perimeter of the body of water.

In FIG. 1 is shown a playing board. It is intended that the playing board be constructed of stiff paper board or other suitable material with a playing surface made of a laminated graphic illustration as is a known method of board game construction by industry. The playing surface has a representation of a body of water (1) and has a continuous series of identified spaces (2) forming the perimeter of the body of water. The continuous series of identified spaces could however, be of any configuration or shape and remain within the spirit and scope of the invention. Also shown on the playing surface of the game board are Bait card (3) and Bite card (4) representations which represent a plurality of Bait and Bite cards. Represented by the numeral (5) in FIG. 1 identifies the games starting point. Represented by the numeral (6) in FIG. 1 identifies a simulated boat dock bearing the indicia "Buy Tackle".

Figure 2:
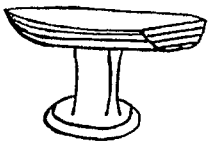
FIG. 2 shows the representation of a game piece in the shape of a boat.
Figure 3:
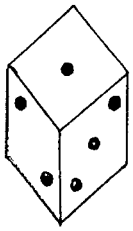
FIG. 3 shows a representation of a 6 sided die.
Figure 4:
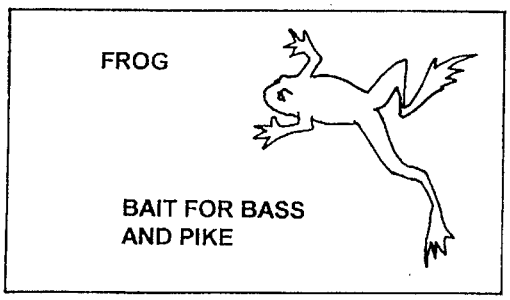
FIG. 4 shows a representation of 1 sample of a bait card identifying a simulated fishing bait.
Figure 5:
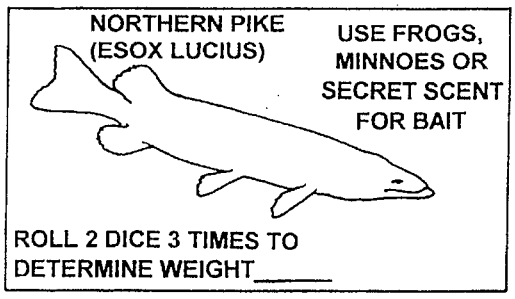

Prior to the start of game play the players themselves appoint and identify the game officials. They are—The Banker, who is responsible for handling all monitary transactions during the game play. The Game Warden—who is responsible for enforcing the rules and regulations of the game according to the manual of rules and directions of play, exhibit A. And the tackle shop proprietor who issues rod and reel cards. Players then each receive 1 rod card, FIG. 7, 1 reel card, FIG. 6 a specific amount of monitary representation, FIG. 9, and a game piece, FIG. 2, in the shape of a boat representing each player by a different color. Bait and Bite card piles are shuffled and placed at their respective locations face down. Each player then places their respective game piece at the games starting point. Players then roll 1 die, FIG. 3, 1 time to determine the high roller as indicated by the numerical value of the die roll. High roller begins play by rolling two die in an attempt to qualify for a fishing license as represented in FIG. 8, to qualify for a fishing licence each player must either roll doubles, two die of the same number, or roll their third turn in succession with the other players. Once a player has acquired the license the player enters play by following the path of the continuous series of identified spaces according to the numerical value of the dice roll. The player must then take the action as directed by the indicia on the board space. When the player's game piece by way of their respective dice roll, lands on the board space indicating Bait, FIG. 1, #7, the player then draws a bait card from the bait card pile, FIG. 1, #3. The bait cards, FIG. 4, represent a plurality of simulated fishing baits and are retained by the player for future use. When the player's game piece, by way of their respective dice roll, lands on a board space indicating Bite, FIG. 1, #8, the player then draws a Bite card from the Bite Card pile, FIG. 1, #4. The Bite cards, FIG. 5, represent a plurality of fish species. The player then determines if the Bite card correctly corresponds with previously acquired Bait cards as directed by the indicia on the Bite and Bait card, FIGS. 4 & 5, providing the Bait and Bite cards correspond as required, the player then decides whether or not to use the Bait card on that specific fish or to throw the Bite card back and try for a larger fish species that also corresponds with that particular Bait card. Should the player decide to keep the fish represented by the Bite card, FIG. 5, the player must then return the used Bait card to the bottom of the Bait card pile. Used Bait cards and uncaught or thrown back Bite cards are returned to the bottom of their respective piles face up to identify when the piles have been used up, each pile is then reshuffled. To weigh the fish caught as represented by the Bite card, the player must roll the die or dice as directed by the indicia on the Bite card, FIG. 5. The player writes the weight as represented by the die numerals in pounds, on the bite card with a grease pencil provided with the game pack, or other suitable writing instrument. The Bite card is retained by the player to serve as a record of catch.

During game play the participants may encounter, by way of the indicia represented on the board spaces, FIG. 1, numeral 9, a situation in which the player may lose possession of the players reel or rod card (FIG. 6 or 7). In this situation the player is no longer properly outfitted and may not draw a Bite card when landing the players game piece on the Bite space represented on the game board. The player may only become requalified by acquiring a replacement rod or reel card. Acquisition of rod or reel cards is accomplished by the player by landing on the board space indicating buy Tackle, FIG. 1, numeral 6. The player then pays a monetary representation to the Banker and receives a rod or reel card. Also during play of the game the participants may encounter by way of the indicia represented on the game board spaces or on the Bait or Bite cards, a situation in which the player loses possession of 1 or more fish, FIG. 1, numeral 10, as represented by the players Bite cards. In some cases of the situation the choice of which fish is lost will be according to the choice of the player losing the fish. In other cases of the situation the choice of which fish is lost may be that of another player. The monetary representations utilized in the game accomplish purchases of tackle, the payments of fines and penalties etc. and have no bearing on the determined winner. The games conclusion takes place when a predetermined time limit expires. The games winner is the player who possess the most total weight of fish, as represented by the players Bite cards, in poundage. The fish species represented by the Bite cards may be any of a variety of fresh or salt water species and may be of a variety of weight ranges as indicated by the dye or dice roll. A variety of simulated Baits may be utilized to correspond with the variety of fish species as represented by the Bite cards and would remain within the scope of the invention. An advanced version of the game may be played by incorporating weight and bag limits as indicated in the chart of Baits and weights on pages 6 and 7 of exhibit A.

I claim:

1. A board game comprising a playing board on which is represented a body of water having a continuous series of identified spaces forming a path on which players move respective game pieces according to a numerical value resulting from a roll of one or more dice; and also comprising a monetary representation, Tackle cards, bait cards, and Bite cards; and in which during play of the game, the players are required to maintain possession of Tackle cards representing certain fishing tackel equipment, the possession of which qualifies the player to draw Bite cards which each represent one of variety of fish species; wherein the players use the monetary representation to purchase said Tackle cards; and wherein any player in possession of a Tackle card is qualified to draw a Bite card when the player's game piece lands on a predetermined space, but is disqualified from drawing a Bite card if not in possession of a Tackle card wherein the Bite cards carry indicia which indicate several characteristic weights of the respective species of fish that the Bite card represents, and the fish weight that the player is entitled to score is determined by matching a roll of one or more dice to the indicia on the Bite card.

2. A board game as recited in claim 2, wherein the Bite card includes a space for the player to record the fish weight, employing a writing instrument provided for that purpose.

* * * * *